United States Patent [19]

Ma

[11] Patent Number: 4,582,078

[45] Date of Patent: Apr. 15, 1986

[54] STEPLESS DIRECTION-BENDING DEVICE OF THE CENTRAL ROD FOR THE UMBRELLA

[76] Inventor: Mark J. S. Ma, 2nd Fl., 461, Kwang Fu S., Rd., Taipei, Taiwan

[21] Appl. No.: 661,092

[22] Filed: Oct. 15, 1984

[51] Int. Cl.[4] ..... A45B 17/00

[52] U.S. Cl. ..... 135/20 M; 135/25 R

[58] Field of Search ..... 135/20 A, 20 M

[56] References Cited

U.S. PATENT DOCUMENTS

| | | | |
|---|---|---|---|
| 2,721,569 | 10/1955 | Militano | 135/20 M |
| 3,150,671 | 9/1964 | Frey | 135/20 M |
| 3,175,568 | 3/1965 | Kafka | 135/20 M |
| 3,182,673 | 5/1965 | Small | 135/20 M |
| 3,311,119 | 3/1967 | Pearlstine | 135/20 M |
| 3,521,651 | 7/1970 | Pearlstine | 135/20 M |
| 3,926,202 | 12/1975 | Uthemann et al. | 135/20 M |

FOREIGN PATENT DOCUMENTS

| | | | |
|---|---|---|---|
| 683187 | 2/1965 | Italy | 135/20 M |

*Primary Examiner*—Robert A. Hafer
*Assistant Examiner*—Daniel Nolan
*Attorney, Agent, or Firm*—Abelman Frayne Rezac & Schwab

[57] ABSTRACT

A stepless tilting mechanism for an umbrella includes a carriage slidable on a hinged upper portion of the mast and which is moved axially against a spring bias after the umbrella has been opened, in order to operate a linkage fast with the upper mast and which reacts against abuttments provided on a fixed lower portion of the mast in order to effect tilting of the upper portion on the mast relatively to the lower portion thereof.

1 Claim, 4 Drawing Figures

STEPLESS DIRECTION-BENDING DEVICE OF THE CENTRAL ROD FOR THE UMBRELLA

FIELD OF THE INVENTION

This invention relates to a tilting mechanism for a large umbrella, such as a large beach or garden umbrella.

BACKGROUND OF THE INVENTION

Beach or garden umbrellas incorporating tilting mechanisms have long been known, but invariably have been either difficult to adjust, or, have required complex and failure prone mechanical adjusting mechanisms.

In their simplest form, the respective upper and lower sections of the mast are hinged to each other by a manually adjustable joint including a bolt passing through the two halves of the hinge joint, and a hand-operable clamp nut, whereby the two halves of the hinge joint can be clamped to each other in their required angular relationship. Such mechanisms are difficult to operate, in that the user must hold and position the upper portion of the mast carrying the weight of the umbrella, while operating the clamp nut with the other hand.

Numerous winch operated structures have been proposed for raising and extending the umbrella by means of a pull cord. Mechanisms also have been proposed which will cause tilting of the upper portion of the mast in a stepless manner, if operation of the winch is continued after the umbrella has been fully raised and extended. An example of such a mechanism is described in Militano U.S. Pat. No. 2,721,569, issued Oct. 25, 1955, in which continued operation of the winch after fully raising and opening of the umbrella causes operation of a linkage between the upper and lower portions of the mast, and an adjustment of the tilt of the upper portion of the mast relative to the lower portion. The mechanism proposed is somewhat complex, and includes numerous sliding parts, linkages and pivots, each of which is subject to wear and contamination by dust or sand.

SUMMARY OF THE INVENTION

It is an object of this invention to provide an extremely simple and inexpensive stepless tilting mechanism for an umbrella, which is highly reliable and positive in its operation, and, which requires relatively fewer moving parts.

According to the present invention, the stepless tilting mechanism for an umbrella includes dual mast sections providing upper and lower mast sections, and a pivot pin extending transversely of the axis of said respective mast sections and pivotally interconnecting the upper end of said lower mast section and the lower end of said upper mast section.

A first link is pivoted at one of its ends to the lower end of said upper mast section at a position spaced from one side of a plane including the longitudinal axis of said upper mast section and the axis of said pivot pin, the first link extending downwardly beyond the lower end of said upper mast section.

A second link is pivotally connected at one of its ends to the other end of said first link, and extends upwardly on an opposite side of the plane including the axis of said upper mast section and the axis of said pivot pin.

A rod extends axially within the upper mast section and is connected at its lower end with the other end of the second link, whereby an upward pull on the rod will cause the first and second links to hinge relative to each other to increase the included angle between said links.

A transverse pin is connected to the upper end of the rod and extends transversely of the upper mast section and outwardly thereof through elongate slots extending axially of the upper mast section.

A spring urges the transverse pin and the rod downwardly within the upper mast section in a direction to decrease the included angle between the links.

A runner for stays of the umbrella is slidable on the upper mast section and is engageable with the transverse pin upon full extension of the umbrella.

Winch and cable members are carried by one of the upper and lower mast sections and move the runner upwardly on the upper mast portion to extend the umbrella, and, on continued movement in upward direction, to move the transverse pin and the rod upwardly against the spring bias, whereby to increase the included angle between the first and second links, and to move the other end of the first link to an opposite side of the said plane, for the first link to extend transversely of that plane.

A socket member is provided on the upper end of the lower mast section and has an elongate socket within which the first and second links are held laterally and are slidably received and axially moveable within the elongate socket.

Camming and reaction surfaces are provided on opposite upper surface portions of the socket member respectively engaging the mutually opposite edges of the respective first and second links, in order to immobilize the upper mast section against hinging movement about said pivot pin.

In this manner, upward movement of the rod and the resulting increase in included angle between the links, and, the rotation of the said one link relative to the lower end of the upper mast portion, causes the pivotally interconnected other end of the first link and the said one end of the second link to move upwardly within said socket, and in turn cause the camming and reaction surface in contact with the first link to tilt the upper mast section about the axis of the pivot pin, while simultaneously causing the camming and reaction surface in contact with the second link to retain and support the upper mast section in the inclination to which it has been tilted.

DESCRIPTION OF THE DRAWINGS

A preferred embodiment of the invention is illustrated in the accompanying drawings, in which.

DESCRIPTION OF THE PREFERRED EMBODIMENT

Figures 1, 2:
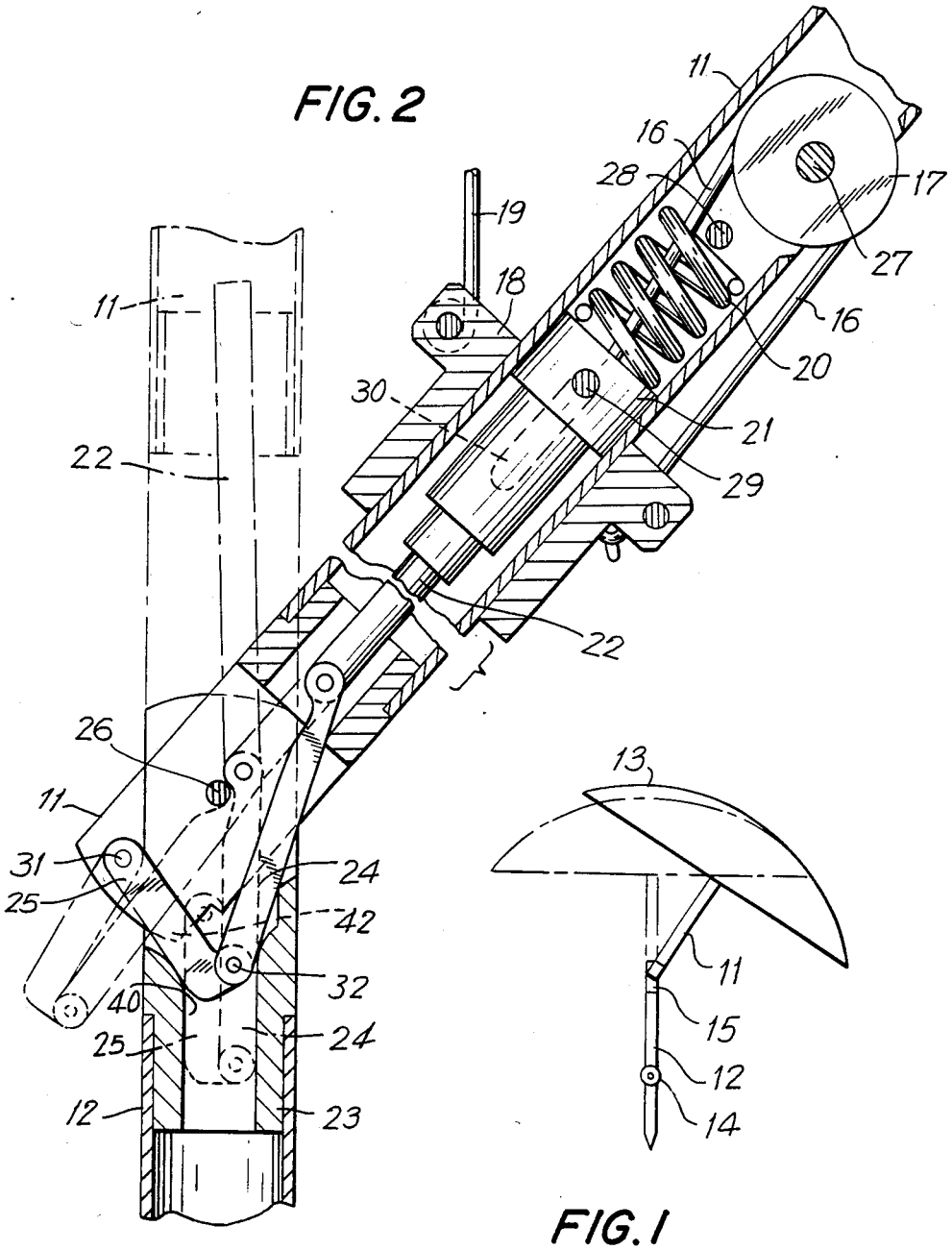
FIG. 1 PRIOR ART
FIG. 1 is a diagrammatic illustration of an umbrella having a tilting mechanism according to the present invention.
FIG. 2 is a cross-section through the upper and lower mast sections of FIG. 1 and shows the tilting mechanism in detail.

As shown in FIG. 1, the central mast of the umbrella comprises an upper mast section 11 that supports the umbrella 13, and a lower mast section 12 provided with a winch 14 used to open and close the umbrella. The upper and lower sections of the mast are connected by the tilting mechanism of the present invenetion and which is indicated generally at 15.

When the crank handle of the winch 14 is rotated, and as is shown more clearly in FIG. 2, a pull cord 16 extending over a guide wheel 17 near the top of the upper mast section 11, causes a runner 18 to move upwards, thus causing the support ribs 19 carried by the runner to extend the umbrella to its open form.

After the umbrella is opened, continued rotation of the crank handle 14 will cause the runner 18 to move even further in an upward direction against the resistance provided by the extended umbrella. It is this further movement of the runner 18 that is utilized to actuate the tilting mechanism 15 and cause the upper mast section 11 to tilt.

The tilting mechanism is contained mainly within the upper mast section, and includes a carriage 21 slidable within the upper mast section, to which is connected a rod 22. The rod 22 in turn is pivoted at its lower end to a link 24, which in turn is pivoted at 32 to a link 25, the opposite end of the link 25 being pivoted at 31 to the lower end of the upper mast section 11.

Figure 3:
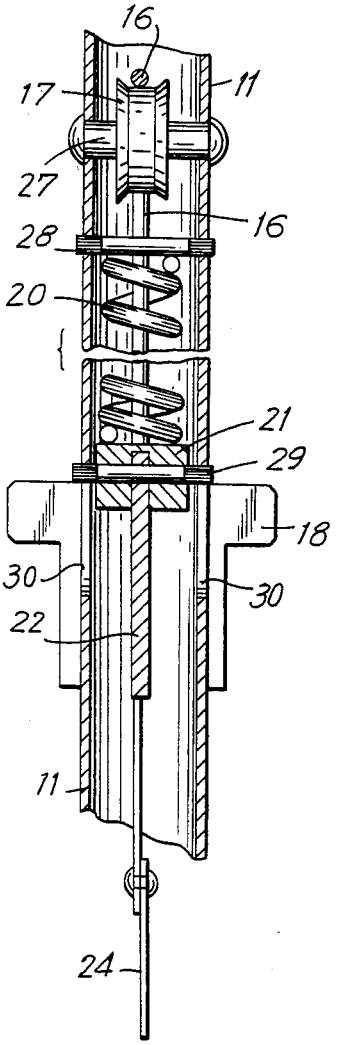
FIG. 3 is a transverse cross-section through an actuator for the tilting mechanism of FIG. 2; and, FIG. 4 is a transverse cross-section through a hinge joint between the upper and lower mast sections of FIG. 2.
Figure 4:
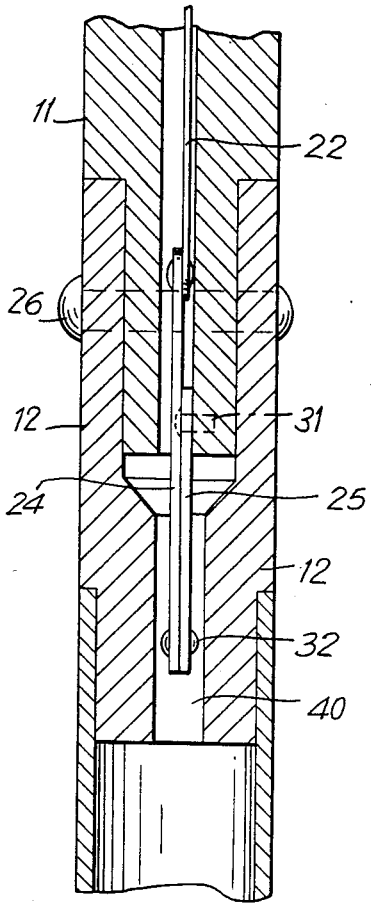

As shown in FIGS. 2 and 3, the guide wheel 17 is rotatable on a journal pin 27. A spring 20 engages a fixed pin 28, and reacts against the carriage 21 to bias the carriage downwardly. A pin 29 extends through the carriage 21 and through the upper end of the connecting rod 22 and extends outwardly of the upper mast section through elongate slots 30 in the upper mast section 11. The outwardly extending ends of the pin 29 lie in the path of movement of the runner 18, such that continued upward movement of the runner 18 will move the pin 29 upwardly in the slots 30, and in turn move the carriage 21 and the rod 22 upwardly against the bias of the spring 20.

Upward movement of the carriage 21 and the rod 22 will cause the links 24 and 25 to move relative to each other in a direction to increase the included angle between the respective links from the position shown in chain dotted lines, to the position shown in full lines in FIG. 2. Downward movement of the carriage 21 and the rod 22 will cause an opposite movement of the links 24 and 25 to move them into axial alignment with the upper mast section 11, in which position the respective links extend downwardly beyond the lower end of the mast section 11.

The upper mast section 11 and the lower mast section 12 are connected by a pivot pin 26. The links 24 and 25 extend downwardly into a socket 40 provided in the upper end of the lower mast section 12.

Prior to tilting of the mast, the link 24 engages and is positioned by the pivot pin 26, and the links 24 and 25 are fully extended into the socket 40.

In this position of the mechanism, the upper mast portion is restrained against tilting in either direction by virtue of the links 24 and 25 being positioned within and engaging the opposite side walls of the socket 40 at the upper end of the lower mast section.

The link 24 at this time lies in edge engagement with the adjacent side wall of the socket 40, and is wedged in that position by the link 25.

Counter clockwise tilting of the upper mast section relative to the lower mast section is at that time prevented by interengaging shoulders 42 on the respective upper and lower mast sections.

Clockwise tilting of the upper mast section relative to the lower mast section is at that time prevented by the link 25 connected to the lower end of the upper mast section 31, and, the engagement of the link 25 with the adjacent side wall of the socket 40. Any attempted clockwise movement will result in the pin 31 applying a greater compressive force between the link 25 and the adjacent side wall of the socket 40, which in turn will be translated into a force further acting to move the link 24 into engagement with the adjacent side wall of the socket. Additionally, engagement of the upper end of the link 24 with the pivot pin 26 precludes any further downward movement of the links 24 and 25, such as would be required in order to permit clockwise movement of the upper mast section relative to the lower mast section.

In this manner, the upper mast section 11 is securely locked to the lower mast section, with the axes of the upper and lower mast sections aligned.

If now the cord 16 is continuously pulled, the runner 18 moves upwards to extend the umbrella and eventually engages the pin 29. Continued movement results in the carriage 21 and the connecting rod 22 being moved upwardly and applying an upward pull on the link 24, this commencing tilting of the upper mast section 11. The extent to which the upper mast section is tilted depends on the extent to which the carriage 18 has moved upwardly.

The upward pull exerted on the link 24, which is at that time aligned with the rod 22 and held against angular movement by the adjacent wall of the socket 40, will result in an upward pull on the lower end of the link 25.

As the distance between the pivot pin 26 and the pivot pin 31 is fixed, and as the pivot pin 31 is located beyond the plane including the axis of the pivot pin 26 and longitudinal axis of the upper mast section, the resulting force is a force acting to rotate the upper mast section in a clockwise section about the pivot pin 26.

The upper mast section will proceed to move in that direction, and, in so moving will move the pivot pin 31 upwardly and laterally of the said plane, at the same time as the link 24 is moving upwardly, and, the included angle between the links 24 and 25 is increasing. In this manner, the respective links are maintained in continuous engagement with the adjacent walls of the socket 40, the walls of the socket 40 thus providing reaction members for the links and stabilizing the upper mast section at any angle to which the upper mast section has been tilted, thus permitting the tilting mechanism to absorb the load impossed on that mechanism by tilting of the upper mast, and loads on the upper mast produced by wind gusts.

To close the umbrella, the crank handle is reversely rotated, causing the runner 18 to desend and the pin 29 to gradually move downward in the slot 30, and, the carriage 21 to move downwardly under the influence of the spring 20. At the same time, the rod 22 gradually moves the links 24 and 25 to decrease the included angle between the links and reinsert the links fully into the socket 40, thus moving the upper mast section into axial alignment with the lower mast section. Continued reverse rotation of the winch 14 then permits the umbrella to be collapsed for storage.

I claim:

1. In a stepless tilting mechanism for an umbrella having:

dual mast sections providing upper and lower mast sections; and, a pivot pin extending transversely of the axis of said respective mast sections and pivotally interconnecting the upper end of said lower mast section and the lower end of said upper mast section;

the improvement comprising:

a first link pivoted at one of its ends to the lower end of said upper mast section at a position spaced from one side of a plane including the longitudinal axis of said upper mast section and the axis of said pivot pin, said first link extending downwardly beyond the lower end of said upper mast section;

a second link pivotally connected at one of its ends to the other end of said first link, and extending upwardly on an opposite side of said plane including the axis of said upper mast section and the axis of said pivot pin;

a rod extending axially within said upper mast section and connected at its lower end with the said other end of said second link, whereby an upward pull on said rod will cause said first and second links to hinge relative to each other to increase the included angle between said links;

a transverse pin connected to the upper end of said rod and extending transversely of said upper mast section and extending outwardly thereof through the elongate slots extending axially of said upper mast section;

spring means urging said transverse pin and said rod downwardly within said upper mast section in a direction to decrease the included angle between said links;

a runner for stays of said umbrella slidable on said upper mast portion and engageable with said transverse pin upon full extension of said umbrella;

winch and cable means carried by one of said upper and lower mast sections and for moving said runner upwardly on said upper mast section to extend said umbrella, and, on continued movement in an upward direction, to move said transverse pin and said rod upwardly against said spring bias, whereby to increase the included angle between said first and second links, and to move said other end of said first link to an opposite side of said plane for said first link to extend transversely of said plane;

a socket member provided on the upper end of said lower mast portion and having an elongate socket within which said first and second links are held laterally and are slidably received and axially moveable within said elongate socket; and, camming and reaction surfaces on opposite upper surface portions of said socket member respectively engaging the mutually opposite edges of the respective first and second links, in order to immobilize said upper mast section against hinging movement about said pivot pin;

whereby upward movement of said rod and the resulting increase in included angle between said links, and, the rotation of said one link relative to the lower end of said upper mast section will cause the pivotally interconnected other end of said first link and said one end of said second link to move upwardly within said socket, and in turn cause said camming and reaction surface in contact with said first link to tilt said upper mast section about the axis of said pivot pin, while simultaneously causing the camming and reaction surface in contact with said second link to retain and support said upper mast section in the inclination to which it has been tilted.

* * * * *